US006384735B1

(12) United States Patent
Rabou et al.

(10) Patent No.: US 6,384,735 B1
(45) Date of Patent: May 7, 2002

(54) DEVICE FOR SIGNALING CONDITIONS FOR ELECTRICAL MACHINES

(75) Inventors: François Rabou, Angouleme (FR); Joachim Stubbig, Beurgneustadt (DE)

(73) Assignee: Schneider Electric Industries SA, Boulogne-Billancourt (FR)

( * ) Notice: Subject to any disclaimer, the term of this patent is extended or adjusted under 35 U.S.C. 154(b) by 0 days.

(21) Appl. No.: 09/450,251

(22) Filed: Nov. 29, 1999

(30) Foreign Application Priority Data

Nov. 26, 1998 (DE) ..... 198 54 666

(51) Int. Cl.[7] ..... G08B 23/00

(52) U.S. Cl. ..... 340/693.5; 340/691.1; 340/321; 340/908.1

(58) Field of Search ..... 340/693.5, 691, 340/691.1, 321, 908, 908.1

(56) References Cited

U.S. PATENT DOCUMENTS 3,728,708 A * 4/1973 Culbertson ..... 340/321
5,103,215 A * 4/1992 Taylor et al. ..... 340/691
5,521,595 A * 5/1996 Totten et al. ..... 340/908
5,684,452 A * 11/1997 Wang ..... 340/908
5,898,380 A * 4/1999 Chi ..... 340/691
5,963,126 A * 10/1999 Karlin et al. ..... 340/691.1

* cited by examiner

*Primary Examiner*—John A. Tweel
(74) *Attorney, Agent, or Firm*—Oblon, Spivak, McClelland, Maier & Neustadt, P.C.

(57) ABSTRACT

The invention relates to a signaling device (1), in particular for industrial purposes, composed of several, at least two optical and/or acoustic signal transmitters, that are arranged essentially linearly next to each other and/or one above the other and connected to a power source via power lines, wherein the signal transmitters respectively have a case (3) in which power consumers (4) for generating an optical and/or acoustic signal are arranged, wherein adjacently arranged cases (3) are interconnected via a coupling member (27), and wherein the power consumers (4) can be connected to each other and/or to the power lines. A generic signaling device (1) of simple structure and that can be assembled essentially without bolt-on connections, wherein preferably simplified maintenance and expansion operations can be performed, in particular in view of replacing defective lighting means (43) and/or other electrical and/or electronic components, without requiring approximately complete disassembly, is provided in that the power consumers are arranged in mountings (42) and the mountings have a conductive device (37) detachably interconnecting the power consumers (4) of adjacent cases (3).

9 Claims, 11 Drawing Sheets

.C–C

DEVICE FOR SIGNALING CONDITIONS FOR ELECTRICAL MACHINES

BACKGROUND OF THE INVENTION

1. Field of the Invention

This invention relates to a signaling device, in particular for industrial purposes, e.g. for signaling various operating and/or malfunctioning conditions, for electrical machines, preferably automatic machines, composed or several, at least two optical and/or acoustic signal transmitters, that are arranged essentially linearly next to each other and/or one above the other and connected to a power source via power lines, the signal transmitters respectively having a case, in which power consumers for generating an optical and/or acoustic signal, e.g. a lighting means, are arranged, wherein adjacently arranged cases are interconnected via a coupling member, and wherein the power consumers can be connected to each other and/or to the power lines.

2. Discussion of the Background

Such signaling devices are known from the state-of-the-art. E.g., DE 90 10 187 U1 discloses an optical indicating device, in particular for industrial purposes, having a long stretched-out, hollow case with at least two longitudinal bands or sections that are at least partially transparent. In this case, a lamp supporting structure is inserted supporting at least two lamps, which are assigned to respective positions in the case bands and electrically connected to power connections arranged in a supporting structure end zone. Furthermore, this known indicating device has at least one electrical connector that is connected to said lamp supporting structure end zone and arranged so as to enable the electrical connection of the lamps and the circuit devices arranged outside the case. The case is composed of several linearly arranged sections that are screwed together. When replacing the lighting means arranged in the lamp supporting structures, it is therefore necessary to open the case at one end and pull out the lamp supporting structure. The drawback of this known device is that light protection between the individual case sections is not possible, so that in particular from a large distance, it cannot be seen which lighting means inside the device is shining. Furthermore, in the event of failures in the lamp supporting structure, the whole lamp supporting structure has to be replaced.

Another signaling device is known from DE 22 11 801 B2. This signaling device is composed of several identical superimposed individual lamps, which respectively comprise a transparent hood being fastened to a horizontal separation wall, whereon a light bulb is seated. Furthermore, feed lines traversing the individual lamps are provided, the ends of which are formed as contact devices for adjacent individual lamps. The separation wall has flexible connection devices that, by rotating the separation wall in relation to the cylindrical hood, in a certain position grip behind shoulders thereof. In addition to the two feed lines for the lighting means of an individual lamp, other feed lines are provided for individual lamps located above.

Finally, FR 1 526 306 discloses a signaling device with several superimposed case sections, wherein respectively one lighting means is inserted. The superimposed case sections are arranged between a base and a lid, the base being connected to the lid via threaded rods and/or screws.

SUMMARY OF THE INVENTION

Based on this state-of-the-art, it is an object of the invention to provide a generic signaling device, of sample construction and that can essentially be assembled without bolt-on connections, wherein preferably simplified maintenance and expansion operations can be performed, in particular in view of replacing defective lighting means and/or other electrical and/or electronic components, without requiring almost complete disassembly and without the risk of damaging power lines during maintenance and completion operations.

To achieve this object, provision is made for the power consumers to be arranged in mountings and the mountings to have a conductive device detachably interconnecting the power consumers of adjacent cases.

A signaling device developed according to this teaching in particular has the advantage that the superimposed cases can be separated effortlessly at each transition between two cases by removing the coupling member, wherein spreading apart the adjacent cases thus detached also allows the conductive devices in the adjacent cases to be separated. For this purpose, it is not necessary to mutually rotate both adjacent cases or to undo a screwed connection. Subsequently, the adjacent cases are separated in the previously described manner, so that e.g. the conductive device in the separated case can be replaced or completed or modified with regard to its electrotechnical configuration.

Regarding the case design, it is provided according to another feature of the invention that each case is pot-shaped and composed of a cylindrical hollow tube section, limited at one side by a lid. Preferably, the tube section and the lid are formed integrally and made of plastic, preferably by the deep-drawing method.

Furthermore, provision is made for the lid to be light-proof, so that light energy is not transmitted from one case, in which a lighting means is shining, into an adjacent case, in which the lighting means is not supplied with electric energy.

The tube section is made of a translucent material, in particular color-dyed, preferably of ductile hard plastic.

Furthermore, provision is made for the lid to have openings for routing the conductive device or parts thereof to provide secure power transmission from one case into the adjacent one.

In order to avoid pollution, such as dust and in particular moisture, from penetrating, a seal can be placed on the case at the shoulder, the seal water-and/or airproofing the transitional area between adjacent cases. This also prevents corrosion at the electrical and/or electronic components, in particular metal conductors.

According to another feature of the invention, provision is made for allowing the case to be connected to a case base, which can be fastened directly or indirectly to the device to be monitored. Furthermore, provision is made for allowing the case to be connected preferably at the lid to a closing lid, which can be fastened to the case by means of a coupling member. This allows, the closing lid to be easily fastened at the uppermost case. When the inventive signaling device is to he expanded, the closing lid can be removed once the closing member has been detached and another case stacked up, before placing the closing lid on the stacked up case and fixing in thereto via a coupling member. The coupling member previously arranged between the closing lid and the uppermost case and detached can now be used either for connecting the two uppermost adjacent cases or for connecting the closing lid to the uppermost case. Consequently, as spare parts or expansion parts for expanding an inventive signaling device, only one case and one coupling member can be provided. Of course, the electrical and/or electronic components arranged inside the case are also part of such an expansion module.

The conductive device preferably has, at opposite ends, at least one plug and at least one socket, which are interconnected electrically. In this embodiment, the assembly of the inventive signaling device is considerably simplified, because by mutually assembling adjacent cases, the conductive devices are interconnected as a plug-in connection. In this case, the conductive device can either be permanently connected to the case and stacked simultaneously or, in a first step, the conductive device with its plug can be plugged into the socket of the adjacent case, before pulling the case over the conductive device, so that the socket of this case in turn is ready to receive the plug of the next conductive device. At any rate, this results in a considerably simplified assembly, especially because bolt-on connections between the individual cases can be omitted.

Plug and socket are preferably developed with multiple poles, so that through different pole configurations, the various lighting means or acoustic signaling means can be controlled in the various cases of the inventive signaling device, without requiring additional power lines. Furthermore, the conductive devices or printed boards can receive electronic components, such as capacitive, inductive or ohmic resistors as well as transistors or the like, in order to form certain circuits inside a case. Consequently, for the inventive signaling device, it is possible that, in addition to purely electrical signaling devices, electronically controlled signaling devices can be used, wherein the electronics of such signaling devices can be housed in the corresponding case. Consequently, it is possible to combine electrically and electronically controlled signaling devices, wherein the subsequent integration of electronic signaling devices in an already existing inventive signaling device is possible, without therefore requiring considerable interventions in the overall structure of this signaling device.

According to another feature of the invention, provision is made for the mounting to be essentially U-shaped and to have two legs as well as a leg-linking bar. Preferably, the power consumer is arranged and fixed between the two legs. The socket is provided at the free end of one mounting leg.

In particular, the mounting is formed of two pieces, wherein both mounting halves can preferably be assembled by means of at least one snap connection. The advantage of this embodiment is that screwing the two halves can be omitted and by dividing the mounting into two pieces, the conductive device can be assembled easily in the mounting, wherein the two halves can be plugged together by interposing the conductive device so that the conductive device is maintained positively or nonpositively between the two mounting halves.

According to another feature of the invention, provision is made for the two halves to have respectively two snap-in hooks and two snap-in recesses. These fixing members interact respectively, i.e. that each snap-in hook of one half is engaged in a snap-in recess of the opposite half. Here it is an advantage to arrange the snap-in hooks at diametrically opposing edges of the mounting halves.

Moreover, the inventive signaling device provides for a housing for a signal transmitter to be arranged at the mounting and preferably and to have an essentially light-proof board, which together with the case defines a chamber, wherein the signal transmitter, preferably the lighting means, is arranged. This embodiment has the advantage that, on the one hand, due to the light-proof lid, and on the other hand, due to the light-proof board, the case is light-proof in both axial directions with regard to adjacent cases, so that the light rays emitted by lighting means arranged in the case cannot penetrate into an adjacent case. As a result, an observer can clearly distinguish the light signals.

The board is preferably arranged at the leg-linking bar of the mounting, wherein it has been found to be advantageous for the board to be circular in shape.

In an alternative embodiment of the inventive signaling device, it is provided for the conductive device to have several, at least two conductor strips. These two mutually separated conductor strips are for supplying the signaling device with the required electric energy. Both conductor strips are integrated in the power consumer and usually embedded into plastic.

According to another feature of the invention, it is provided that the conductive device is made of two pieces, wherein at least one piece of the conductive device has several conductor strips. In this embodiment, it is possible advantageously to use the conductor strips for controlling different power consumers in the individual cases arranged one above the other or next to each other. Preferably, the conductor strips are unwound once or twice in their longitudinally extending plane, in the direction of the surface normal of this plane and/or in a direction extending perpendicularly thereto.

Moreover, it is provided that the conductor strips at one end are formed as plug contacts and at the opposite end at least partially as flexible sockets. The flexible sockets permit secure fitting of the socket contacts at the plug contacts of the adjacent conductive device.

Finally, according to another feature of the invention it is provided that at least part of the conductor strips are divided into several poles, at least at one end. For this purpose, e.g. one conductor strip can be developed so as to slave, on the one hand, a pole for connecting to a lighting means holder as well as one or several poles for connecting to an electrical or electronic circuit. Finally, it can also be provided that in addition to the poles mentioned above, an additional pole is provided, that is also developed as an flexible socket according to the meaning above.

BRIEF DESCRIPTION OF THE DRAWINGS

Further features and advantages of the invention are apparent from the following description of the accompanying drawing representing preferred embodiments of an inventive signaling device. Where.

DETAILED DESCRIPTION

Figure 1:
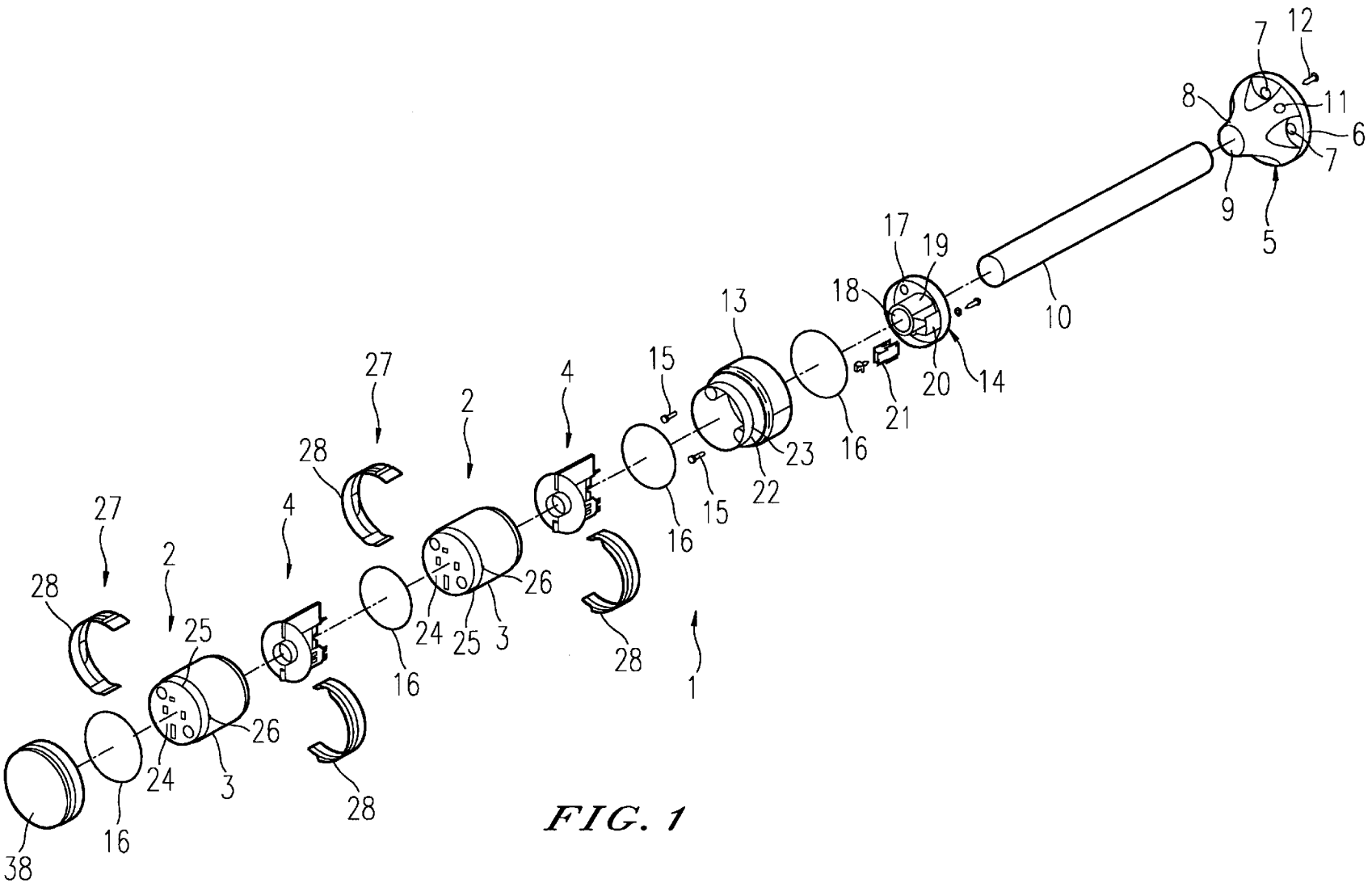
FIG. 1 shows the signaling device in a perspective illustration of an exploded view.

A signaling device 1 illustrated in FIG. 1 is composed of several linearly superimposed signal transmitters 2. Each signal transmitter 2 has a case 3, wherein a power consumer 4 is arranged for generating an optical and/or acoustic signal.

Furthermore, the signaling device 1 has a base 5, which can be fixed to an electrical machine (not shown), e.g. an automatic machine. This base 5 has a circular stand 6, wherein equidistant bores 7 are arranged, through which screws can be introduced connecting base 5 to the machine (not shown).

The base 5 further has an essentially pyramidally shaped adapter body 8, wherein a center bore 9 is arranged for receiving a base rod 10. Furthermore, in, the adapter body 8, a bore 11 extending perpendicularly to bore 9 is arranged for receiving a locking screw 12. Consequently, bore 11 has a female thread cooperating with the male thread of locking screw 12. By means of locking screw 12, the base rod can be fixed nonpositively in the bore 9 of the adapter body 8.

At the base rod 10, opposite to base 5, a case base 13 is fixed together with a base plate 14. The case base 13 is screwed to the base plate 14 by means of screws 15, a seal 16 being arranged between the case base 13 and the base plate 14. For receiving seal 16, the base plate 14 has a shoulder 17, the outer diameter of which matches the inner diameter of seal 16 and of case base 13, so that the case base 13 can be slipped onto the shoulder 17 of the base plate 14.

Furthermore, base plate 14 has a circular opening 18 for receiving base rod 10. The opening 18 is arranged in the center of base plate 14. Between the shoulder 17 and the wall 19 of opening 18, an adapter member 20 with an essentially rectangular section is arranged. This adapter member 20 is meant to receive a socket 21, which is screwed to the base plate and connected to a power source through power lines, not shown in further detail, that are routed through base rod 10 and base 5.

The case base 13 is formed as a tube section, case base 13 having a shoulder 22, whereupon another seal 16 can be slipped. At the shoulder 22, the case base 13 has several, at least two, snap-in recesses 23, which can be engaged with snap-in projections arranged in case 3, so that case 3 adjacent to case base 13 can be slipped upon case base 13 with positional accuracy.

Each case 3 is composed of a pot-shaped section with a lid 24, which is arranged at one end of the pot-shaped case 3 and at its casing surface forms a shoulder 25, the outer diameter of which is smaller than the outer diameter of case 3. In turn on this shoulder 25, a seal 16 can be placed that seals two adjacent causes 3 from each other so that dust and/or moisture is prevented from penetrating into case 3.

Where shoulder 25 merges into the casing surface of case 3, case 3 has snap-in recesses 26 that are formed according to the snap-in recesses 26 that are formed according to the snap-in recesses 23 in case base 13 and consequently also cooperate with respective snap-in projections on the inner surface of the adjacent case 3, so that once cases 3 are assembled, they cannot be rotated in relation to each other.

Connecting two adjacent cases 3 together or one case 3 to case base 13 is done by means of coupling members 27 composed of two ring sections 28 that can be connected together positively. For this purpose, at the ends, each ring section 28 has, on the one hand, a snap-in projection 29 and at least one respective recess 30. Furthermore, at the ends, each ring section 28 has a flattened part 31, wherein the flattened parts 31 of each ring section 28 are arranged, at one end, on the outer surface 32, and at tho second end, on the inner surface 33.

The snap-in projection 29 and the corresponding recess 30 are here arranged at the flattened part 31, snap-in projection 29 extending flush with the free end of ring section 28.

Furthermore, the ring sections have a projection 34 peripheral at the inner surface 33, which cooperates with shoulder 25 of case 3. The result is therefore coupling members 27 fitting flush with adjacent cases 3 or one case 3 and the adjacent case base 13.

Furthermore, on their inner surface 33, the ring sections 28 have bayonet guides 35 that can be engaged with projections standing out beyond the casing surface of case 3, so that adjacent cases 3 in the axial direction are securely connected together.

Each pot-shaped case 3 is made of translucent, in particular color-dyed, ductile hard plastic, wherein the lid 24 is made light-proof. In the lid 24 is an opening 36 for routing a conductive device 37 of the power consumer 4. The exact structure of the power consumer 4 or the conductive device 37 will be described hereafter with reference to FIGS. 2 to 4.

The signaling device 1 illustrated in FIG. 1 further has a closing lid 38 that is slipped upon case 3 arranged at a distance from base 5 by interposing another seal 16 and is connected to case 3. For this purpose, it is also possible to use a coupling member 27 or a coupling ring. However, it can also be envisaged that closing lid 38, having no electrical conductive devices, is screwed onto the last case 3.

The power consumer 4 is composed of the conductive device 37 formed as printed board 39. The printed board is essentially L-shaped and has two legs 40 and 41. In the transitional area of the two legs 40 and 41, a mounting 42 for lighting means 43 is arranged. Alternatively, it is also possible to arrange an acoustic signal transmitter in this area. The mounting 42 is electrically connected to the printed board 39.

Furthermore, in the transitional area of the two legs 40 and 41 of the printed board 39, a plug 44 with a plurality of poles 45 is arranged. Of these poles 45, at least 2 poles 45 are connected electrically with mounting 42, the plurality of poles 45 controlling the linearly superimposed power consumers 4 arranged in the cases 3.

At She end of leg 41, opposite plug 44, the printed board 39 further has a socket 46, which has a number of poles 45 corresponding to the number of adapter openings 52. When the signaling device 1 is assembled, this adapter opening 46 is arranged at the opening 36 in the lid 24 so that the adjacent power consumer 4 can be plugged with its plug 44 into the socket 46 of the power consumer 4 located below and consequently a continuous electrical connection between the power source and the uppermost power consumer 4 in the uppermost case 3 is possible. For this purpose, the printed board 39 can be fitted with electrical or electronic components for controlling and/or biasing certain functions of the power consumer 4. E.q., time delay units can be provided here.

Figure 2:
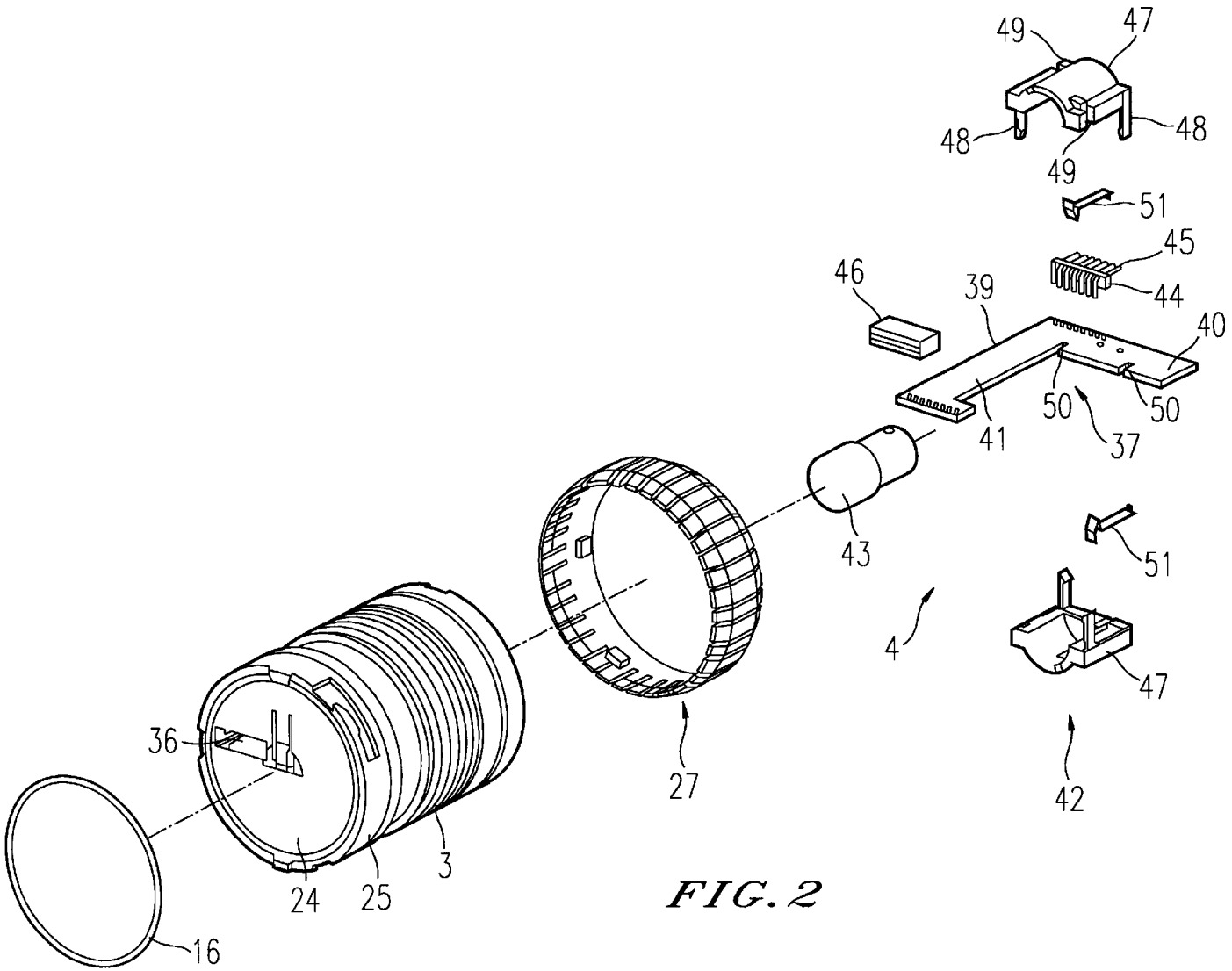
FIG. 2 shows a case with a power consumer in a perspective illustration of an exploded view.
Figure 3:
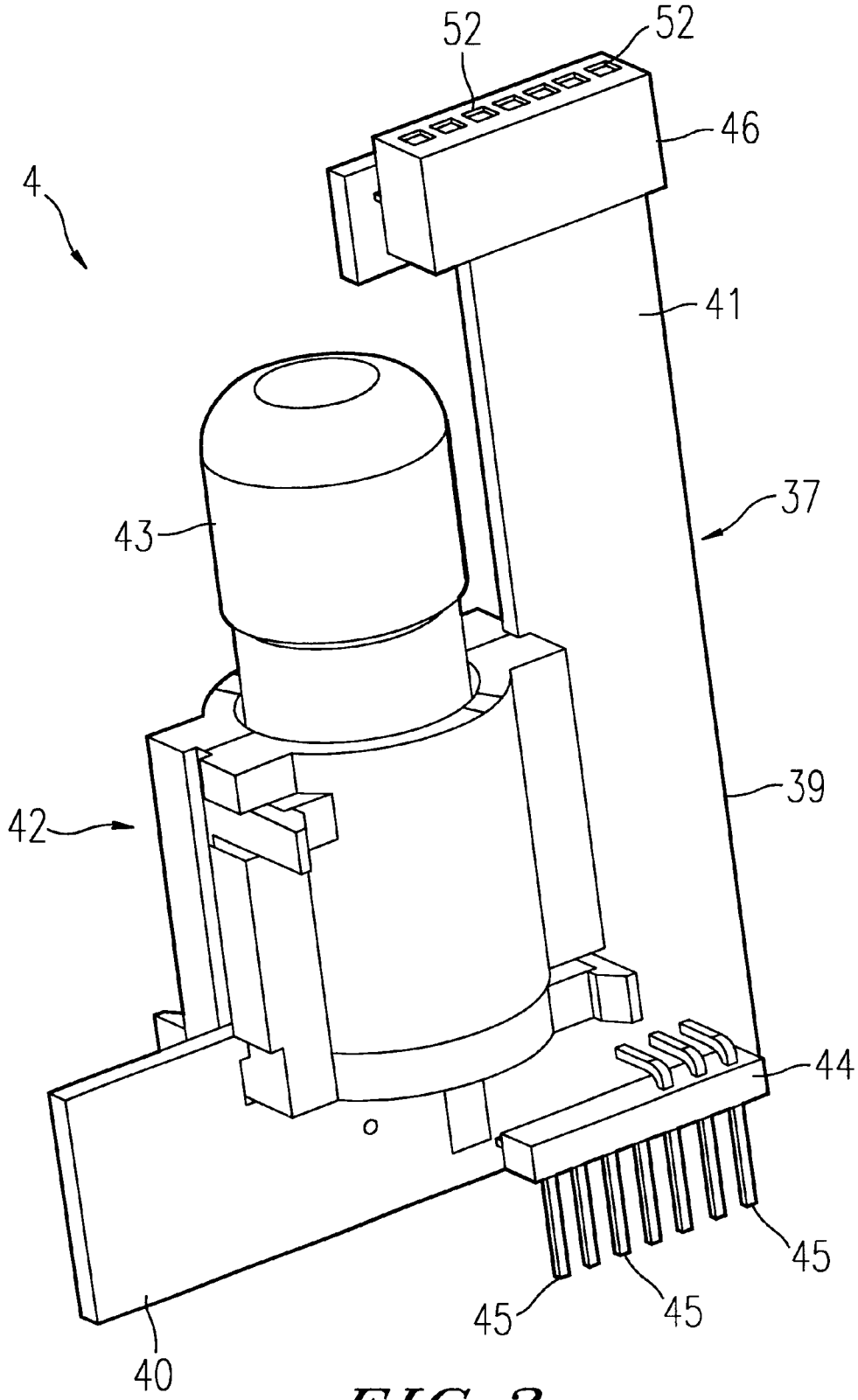
FIG. 3 shows the power consumer according to FIG. 2 in a perspective view.

In FIG. 2, the power consumer 4 is illustrated in exploded view. It appears that the mounting 42 is formed of two pieces and has two halves 47 that can be assembled. For this purpose, each half 47 of mounting 42 has two snap-in hooks 48 arranged in diagonally opposite corner areas as well as snap-in recesses 49 at the corner areas without snap-in hooks 48, into which the snap-in hooks of the second half 47 can be engaged. For fixing the mounting 42, in leg 40 of printed board 39 openings 50 are provided that are traversed by the snap-in nooks 48 arranged at the lower edge area of both halves 47. The mounting 42 is therefore fixed positively to the printed board 39, Furthermore, inside the two halves 47 of mounting 42, electrical contacts 51 are provided, which are electrically connected to at least one pole 45 of plug 44 or to one adapter opening 52 in socket 46.

Figure 4:
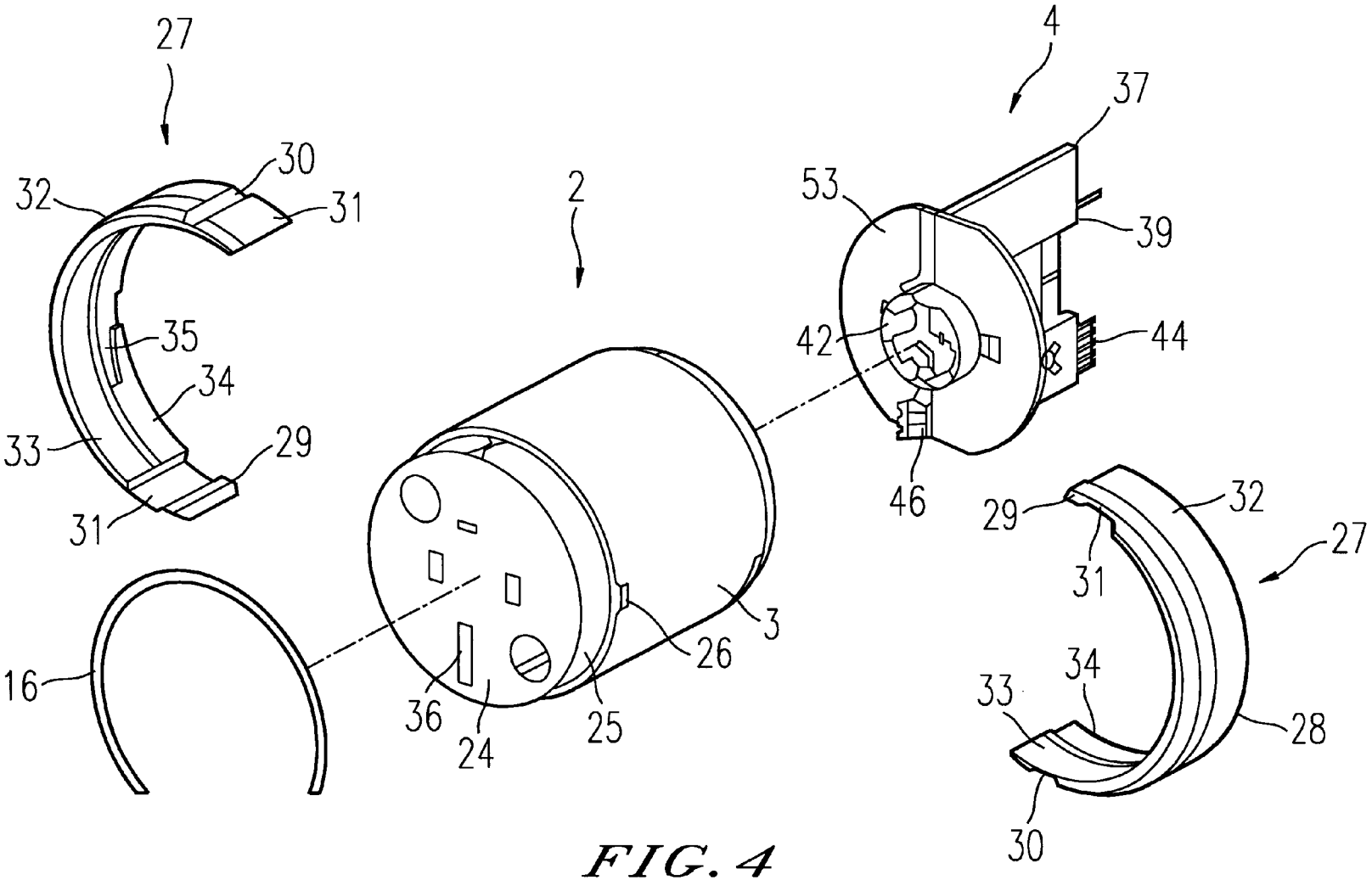
FIG. 4 shows a case with a coupling ring or the signaling device according to FIG. 1.

As is apparent from FIG. 4, the printed board 39 can have an essentially light-proof board 53, which together with the inner wall of case 3 defines in a light-proof way a chamber, wherein lighting means 53 is arranged. For this purpose, board 53 is formed in circular shape, mounting 42 being inserted into the center recess of board 53.

Figure 5:
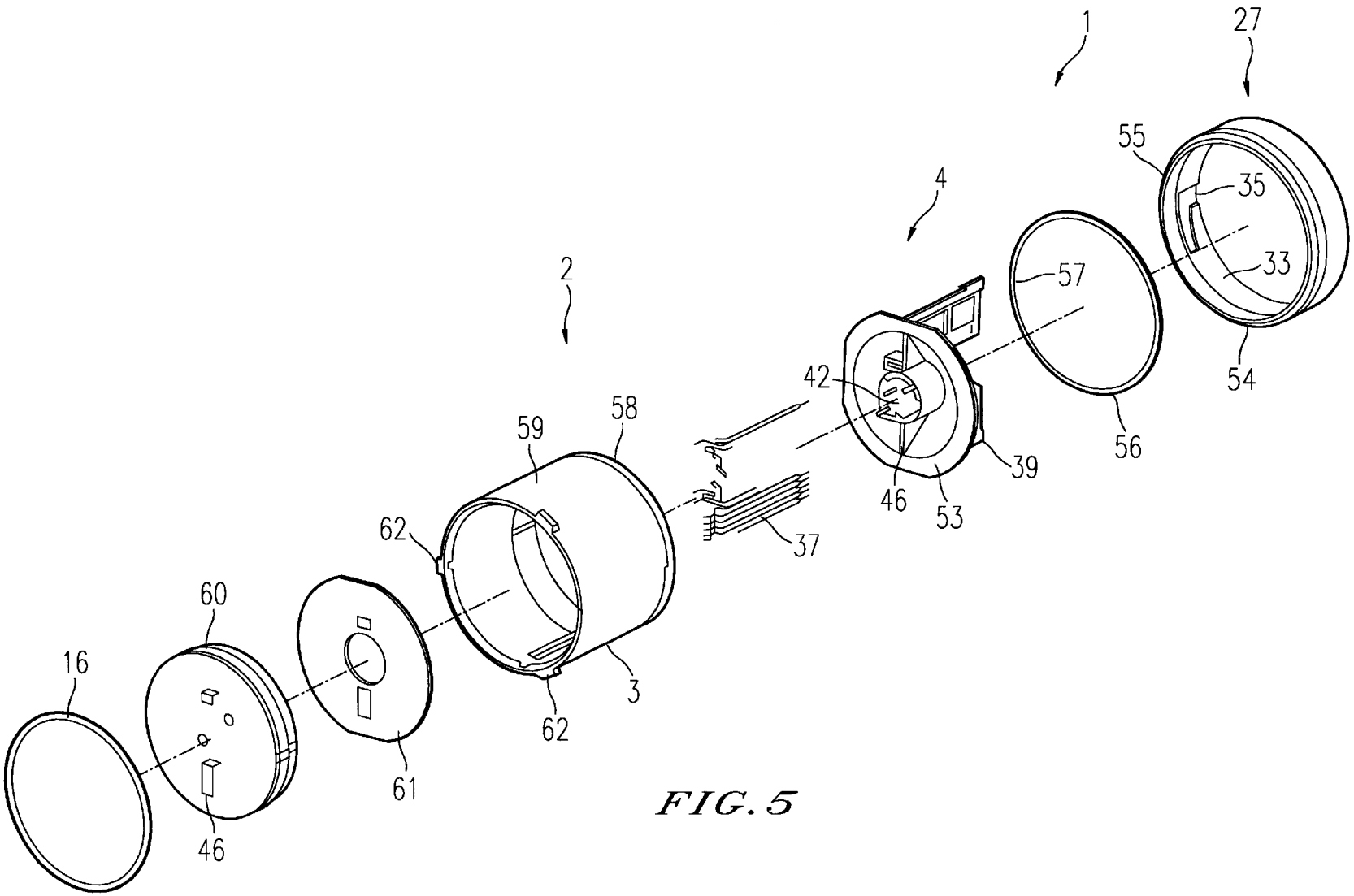
FIG. 5 shows a case with a coupling member of a second embodiment of a signaling device in a perspective illustration of an exploded view.

In FIG. 5, a second embodiment of a signaling device 1 is illustrated, also having signal transmitters 2. In contrast to the first embodiment, described in detail, of the signaling device of FIGS. 1 to 4, this second embodiment of the signaling device 1 according to FIG. 5 has a one-piece coupling ring 54 that is formed at its inner surface 33 according to the two ring sections 28 of FIGS. 1 to 4 and in addition, arranged on the inner surface 33, has an adaptor groove 55 that is peripheral on the inner surface 33 of coupling ring 54. Once the coupling ring 54 is assembled, in this adaptor groove 55, a resilient spring washer 56 is engaged that according to FIG. 5 has a gap or opening 57 so as to have the required radial flexibility. Furthermore, this spring washer 56 is engaged in an adaptor groove 58 that is arranged peripherally in the casing surface 59 of case 3. In this case, the ring washer 56 connects case 3 with coupling ring 54, so that coupling ring 54 cannot be pulled off from case 3 in the axial direction. For this purpose, when coupling ring 54 has been assembled, spring washer 56 stands out beyond the casing surface 59 of case 3 so that, on the one hand, it is engaged with a partial area of its radial extension and adaptor groove 55 of coupling ring 54 and, on the other hand, with the remaining radially area, in the adaptor groove 58 of case 3.

Consequently, when mounting coupling ring 54 on case 3, in a first step, spring washer 56 is placed into the adapter groove 58 of case 3 and pushed with flexible pretension into this adapter groove 58 until spring washer 56 is flush with the casing surface 59 of case 3. In order to achieve the required flexibility and thus press the spring washer 56 into the adapter groove 58, the above-mentioned opening 57 of spring washer 56 is provided. Subsequently, coupling ring 54 is slid in the axial direction over the end of case 3 fitted with spring washer 56 until spring washer 56 releasing its pretension snaps into the adapter groove 55 on the inner surface 33 of coupling ring 54.

Furthermore, it is apparent from FIG. 5 that case 3 is formed as a tube section in to which a lid 60 can be inserted. The seal 16 is arranged between the outer wall of lid 60 and the inner wall, represented as a shoulder in FIG. 5, of case 3. In this embodiment, lid 60 is the same as lid 24 of FIGS. 1 and 4. Below lid 60, a board 61 for fitting electrical and electronic components is provided, which is fitted according to the function of signal transmitter 2. The board 61 is then in electrical contact with conductive device 37, which is an integral component of power consumer 4.

Furthermore, it is apparent from FIG. 4 that at the casing surface 59 of case 3, projections 62 are provided, which correspond to the bayonet guides 35 on the inner surface 33 of coupling ring 54, so that the assembly of adjacent cases 3 is performed so that a case 3 assembled with coupling ring 54 is stacked upon the adjacent case so that the projections 62 are engaged in the respective bayonet guides 35, whereupon coupling ring 54 is adjusted in relation to the two superimposed cases 3, until the projections 62 are wedged in bayonet-style in the bayonet guides 35. The relative movement of coupling ring 54 to the adjacent cases 3 is then possible in that coupling ring 54 is arranged above spring washer 56 at case 3 in a freely rotating manner.

It appears that at case 3, three projections 62 are distributed equidistantly to each other over the circumference of case 3. Of course, the bayonet guides 35 are also arranged correspondingly on the inner surface 33 of coupling ring 54.

Figure 7:
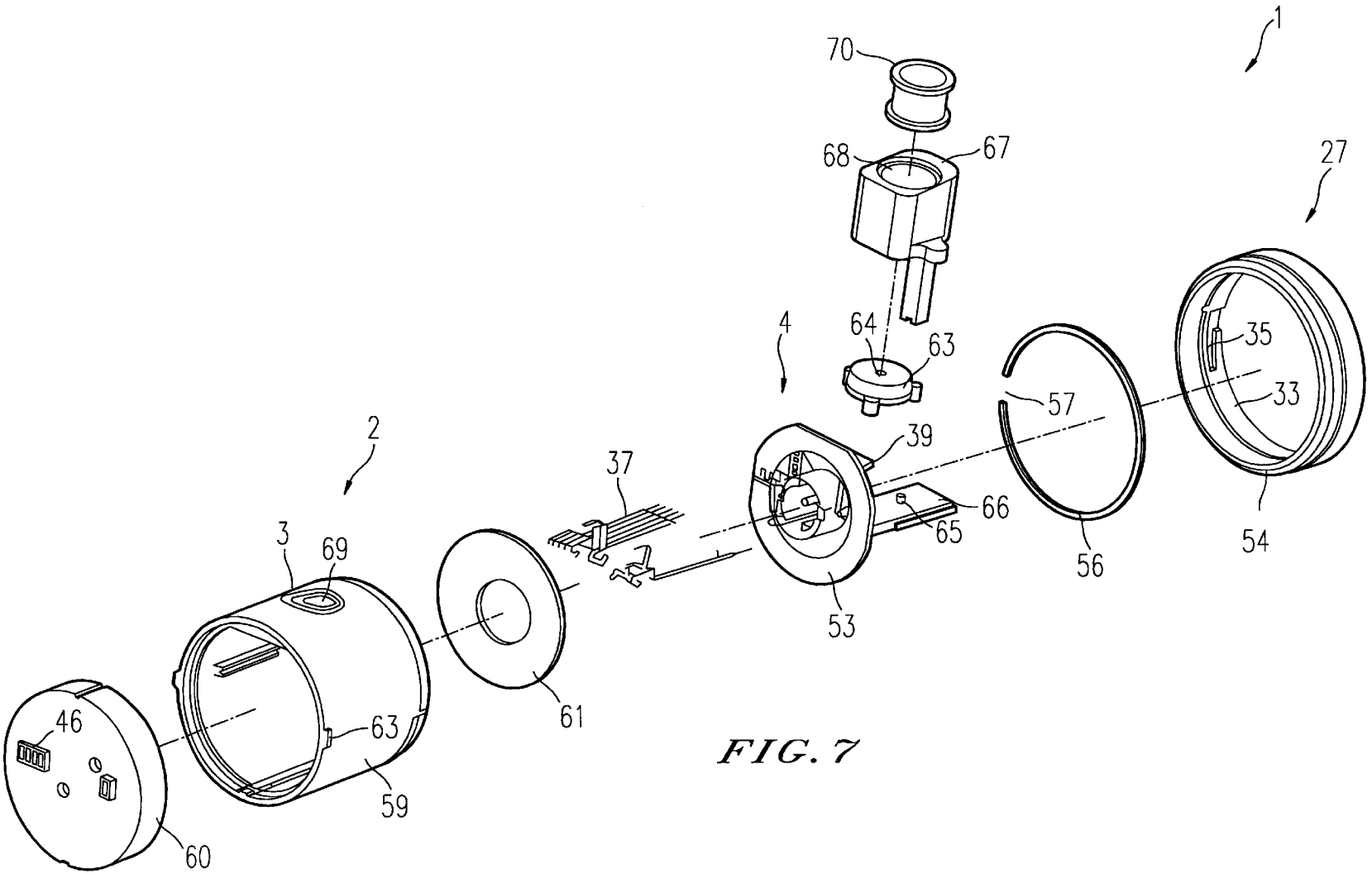
FIG. 7 shows a case with a coupling member and an acoustic signal transmitter, for a signaling device according to FIG. 5 in a perspective illustration of an exploded view.
Figure 8:
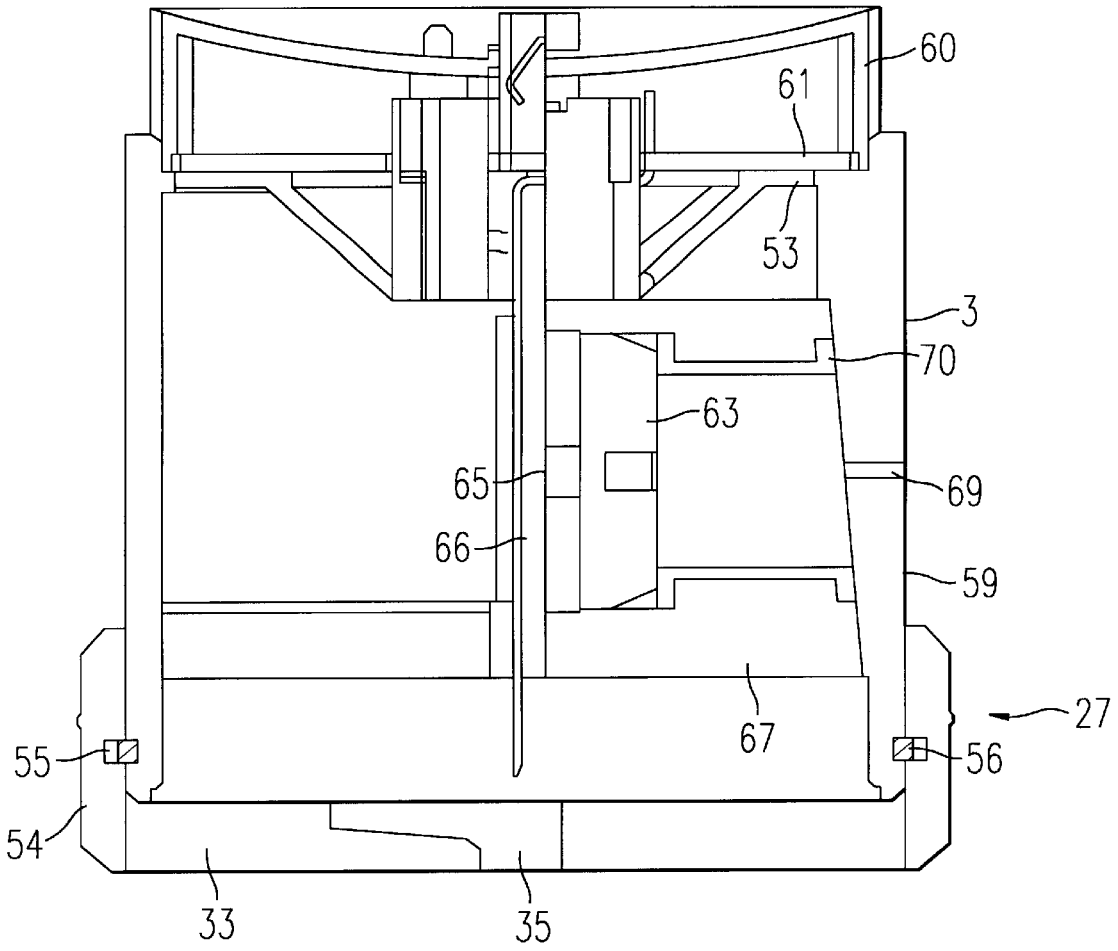
FIG. 8 shows the case with the acoustic signal transmitter according to FIG. 7 in a cutaway lateral view.

In FIGS. 7 and 8, an alternative embodiment of power consumer 4 is illustrated in a signaling device 1. In this case, it is a sound generator 63 that accordingly produces an acoustic signal. The sound generator 63 is essentially shaped as a flat cylinder and in its center has a bore 64 through which the sound generator 63 can be plugged onto a spigot 65 at one leg 66 of power consumer 4.

Moreover, the sound generator 63 is arranged in a mounting 67 that for this purpose has a bore 68 corresponding to the dimensions of the sound generator 63.

Mounting 67 and sound generator 63 are arranged in case 3 so that the longitudinal axis of the sound generator 63 or mounting 67 extends perpendicularly to the longitudinal axis of case 3. In this respect, case 3 has in its casing surface 59 openings 69 that permit unrestrained emission of sound waves from case 3 so that the acoustic signal produced by sound generator 63 can be output essentially without damping by signaling device 1. It has to be mentioned here that this embodiment of case 3 allows to output a very loud and intensive acoustic signal, even if the sound generator 64 only has low performance.

Between the inner surface of case 3 and mounting 67, a vibration reducing mean 70 is arranged that prevents the sound waves generated by sound generator 63 from transmitting vibrations to the case 3, so that such vibrations could cause damage, in particular to the conductive devices 37 or electrical contacts. It appears from FIG. 8 that the vibration reducing means 70 is arranged inside mounting 67, which maintains the sound generator 63 on leg 66 of power consumer 4.

Figure 9:
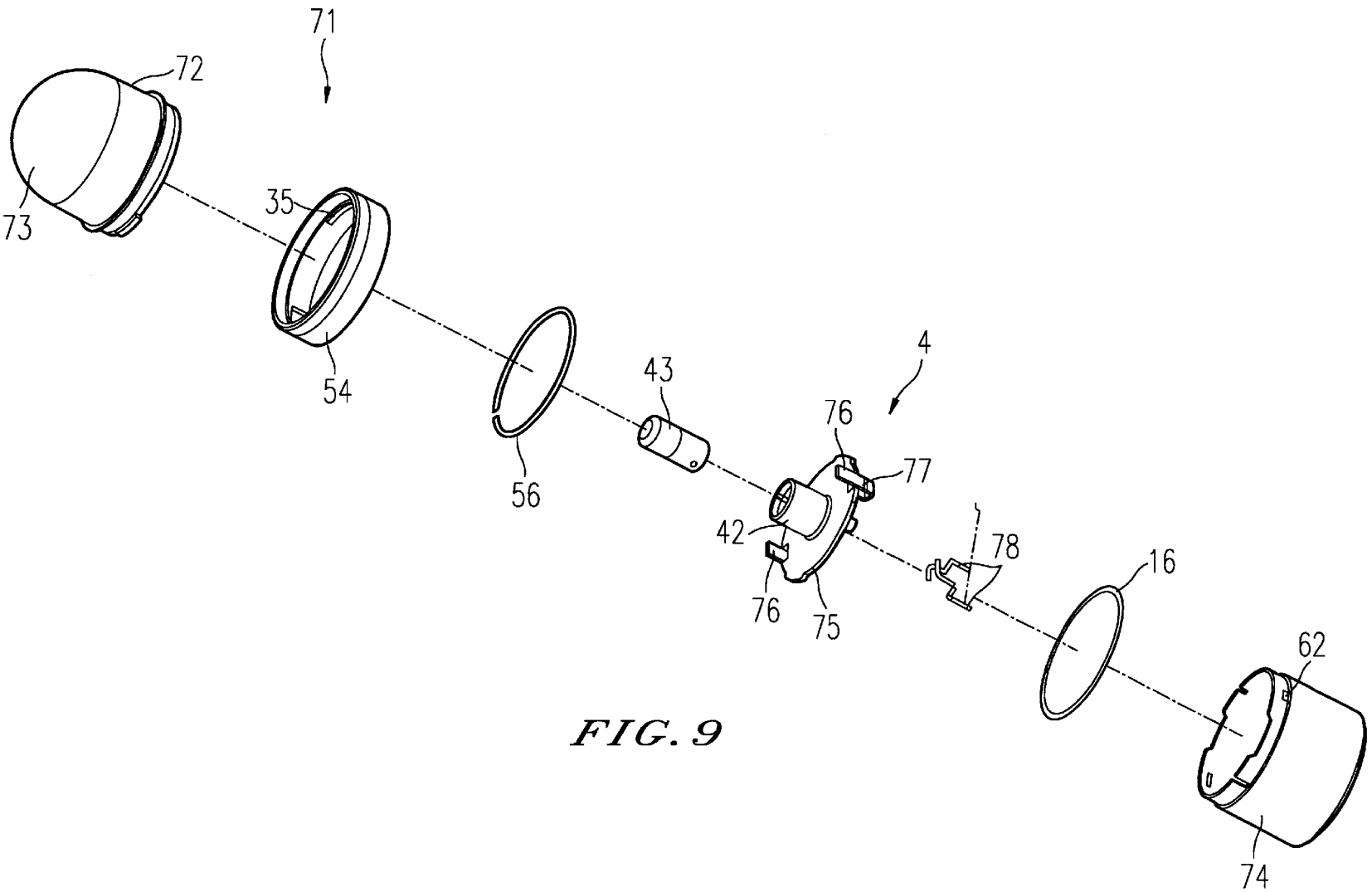
FIG. 9 shows in a perspective illustration of an exploded view of a closing member that can be combined with a signaling device according to FIGS. 1 to 8.
Figure 10:
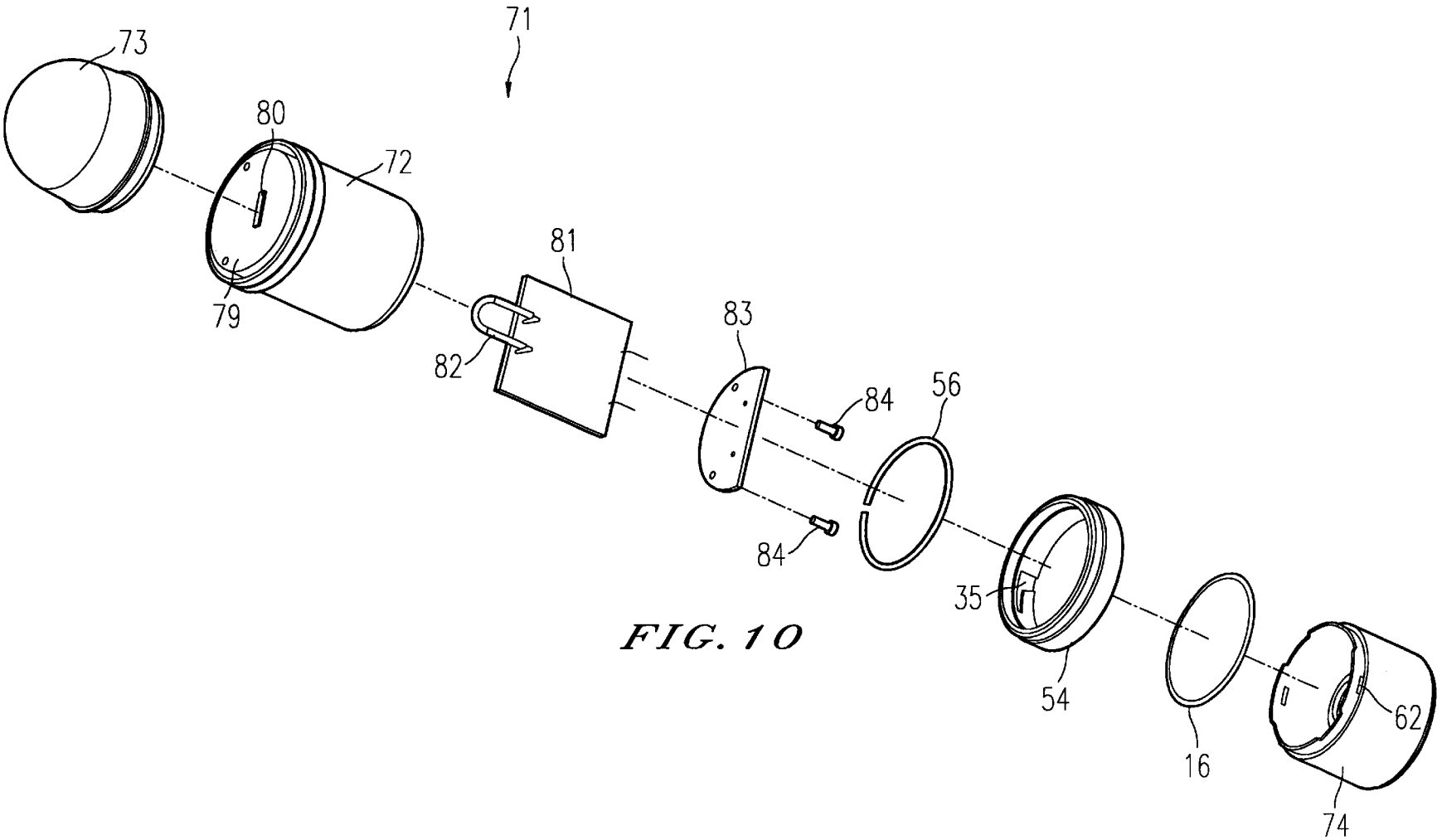
FIG. 10 shows another embodiment of a closing member according to FIG. 9.

Finally, FIGS. 9 and 10 illustrate two alternative embodiments for closing a signaling device 1, which can be blipped on, instead of a closing lid 38 as illustrated in FIG. 1, or can be used alternatively as a signaling device for machines.

Essentially, a closing signal transmitter 71 illustrated in FIGS. 9 and 10 is composed of a dome-shaped case 72 with a dome-shaped glass insert 73, which incidentally can also be made of plastic. Case 72 is connected via coupling ring 54 either to a signal transmitter 2 illustrated in FIG. 5 or FIG. 7, or to a base 74, namely in the manner that has been described above for the connection of two adjacent cases 3. Consequently, closing signal transmitter 71 also has the spring washer 56, with which coupling ring 54 can be fixed to case 72, whereas coupling ring 54 is fixed to base 74 or an adjacent case 3 via bayonet guides 35 and the corresponding projections 62. Inside case 72, a power consumer 4 with lighting means 43 is arranged. The lighting means 43 is inserted in a mounting 42 and connected thereto.

In the illustrative embodiment depicted in FIG. 9 of the closing signal transmitter 71, the power consumer 4 has a plate 75, which has diametrically opposed resilient snap-in members 76. Such resilient snap-in members have radially outward projecting snap-in tenons 77 which snap into respective recesses inside base 74. Through a movement that brings the snap-in members 76 moved closer to each other, the snap-in tenons 77 can be disengaged prom the respective recesses of base 74, so that power consumer 4 can be pulled out easily from base 74. Furthermore, FIG. 9 illustrates the electrical contacts 78 that reach through plate 75 into the mounting area 42 to establish electrical contact with lighting means 43.

FIG. 10 illustrates an alternative embodiment of the closing signal transmitter 71 that is embodied as a flashing device. This closing signal transmitter 71 also has a case 72, whereon a dome-shaped glass insert 73 can be assembled. At one end, case 72 has a lid 79 with a slit 80 extending in the center area of lid 79. Lid 79 is oriented towards the dome-shaped glass insert 73, wherein, below lid 79, i.e. oriented away from the dome-shaped glass insert 73, a board 81 is arranged with an essentially U-shaped flashing device 82. Board 81 is fixed to a fixing plate 83, which .n turn is maintained in case 72 through screws 84.

The flashing device 82 then traverses slit 80 so that it is arranged inside the dome-shaped glass insert 73.

For the rest, the structural design of the fixing members and the related operating mode of this closing signal transmitter 71 is similar to the embodiment of the closing signal transmitter of FIG. 9.

Figure 11:
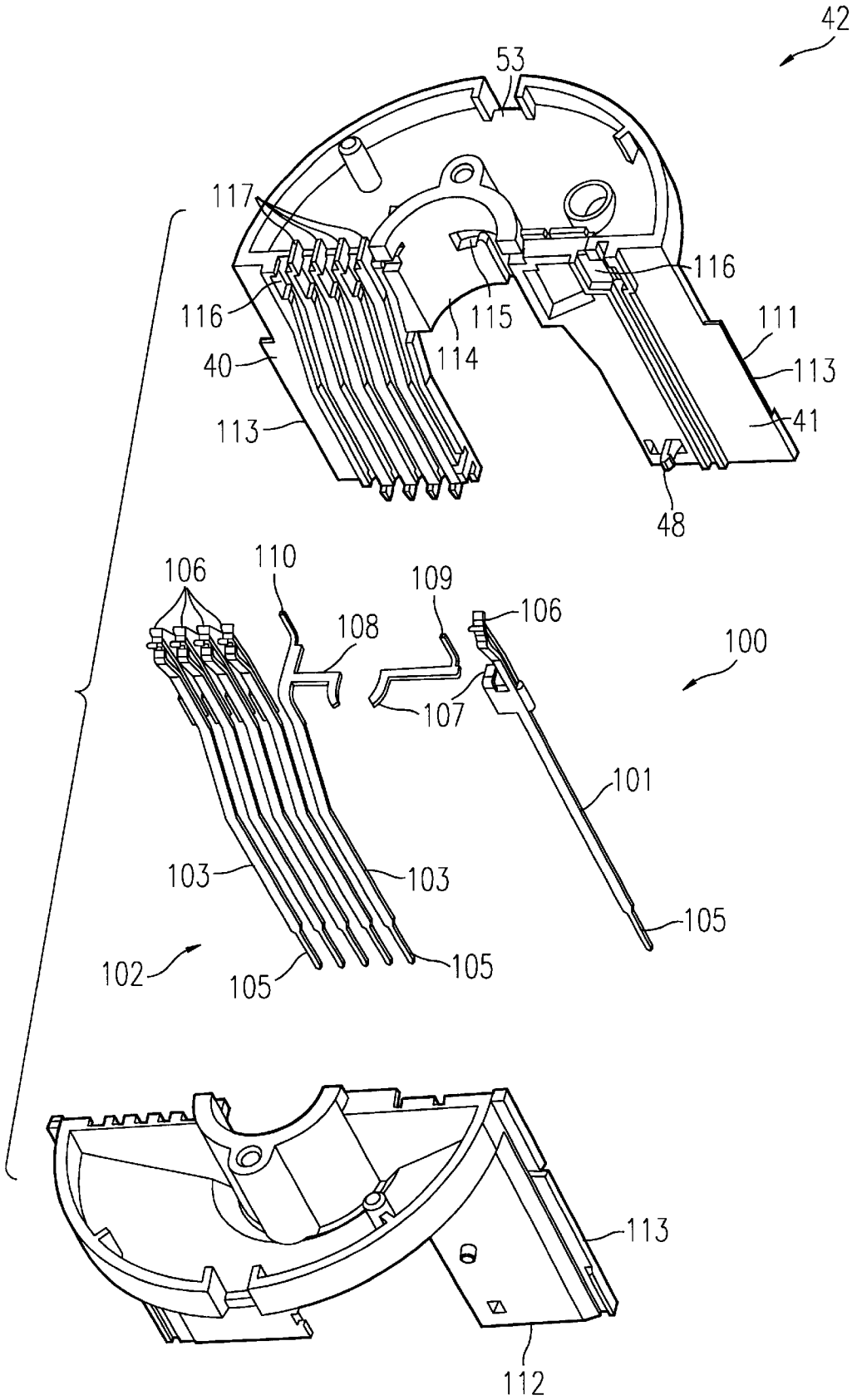
FIG. 11 shows the mounting according to FIG. 6 in a perspective illustration of an exploded view.

FIG. 11 illustrates a mounting 42 with one part 100 of the conductive device 37. Part 100 of the conductive device 37 is composed of a single conductor strip 101 as well as of conductor strip unit 102 electrically insulated from conductor strip 101 and having several conductor strips 103.

Each conductor strip 101 or 103 has aL one end a pin-shaped plug contact 105 and, in comparison to conductor strips 101 or 103, has a reduced diameter or reduced width. At the opposite end of conductor strips 101 or 103 resilient sockets 106 are formed that are essentially V-shaped when seen in side view. These resilient sockets are to be brought in contact with the plug contacts 105 of an adjacent power consumer 4. For this purpose, the sockets 106 are arranged in the socket so that their poles are pressed apart when they are introduced into the plug contacts 105 of the adjacent power consumer 4 and, due to their resiliency, are pressed with sufficiently great strength against the plug contacts 105, so that a secure electrical connection exists between the plug contacts 105 of a power consumer 4 and the sockets 106 of conductor strips 101 or 103 of the adjacent power consumer 4.

As is apparent from FIG. 11, in addition to socket 106, conductor strip 101 has a two-piece pole 107, electrically connected with conductor strip 101, which cooperates with an equivalently formed pole 108, pole 108 being arranged at a conductor strip 103 of conductor strip unit 102. Both poles 107 and 108 are connected to an electrical consumer 4 in the mounting 42 for the lighting means 43, so that the poles 107 and 108 establish the electrical connection with the poles of the lighting means 43.

Furthermore, conductor strip 101 has another pole 109 that can be connected for instance to lines that are arranged on a board and which connect pole 109 to electrical or electronic components, such as resistors, transistors, diodes or the like.

Similarly, conductor strip 103 also has another pole 110 that is arranged at conductor strip 103, which also has pole 108. Pole 110 has the same function as pole 109 of conductor strip 101.

In FIG. 11, it appears furthermore, that mounting 42 is composed of two halves 111 and 112. Mounting 42 has an essentially U-shaped section and consequently has two legs and a bar connecting the legs, wherein the legs are referenced as 40 and 41 and the bar is constituted by board 53. At the outer edges, legs 40 and 41 have projections 113 that expand in T-shape at one end and that can be inserted in respective recesses inside case 3 to secure the mounting inside the case.

It appears furthermore that the mounting has an adapter 114 for the power consumer, namely the lighting means 43. For this purpose, the adapter 114 has at its inner wall a bayonet-shaped opening 115 that is formed as an undercut at its closed end.

Furthermore, mounting 42 has adapters 116 for conductor strips 101 and 103. Between the adapters 116, bars 117 are arranged, so that the conductor strips 103 are electrically completely separated from each other. It appears that conductor strips 103 have a double U-bend in their longitudinally extending plane, in the direction of the surface normal of this plane, and in the direction extending perpendicularly thereto. Conductor strips 103 therefore have a linear offset, on the one hand in relation to the plane of leg 40, and on the other hand in parallel to the plane of leg 40.

Figure 6:
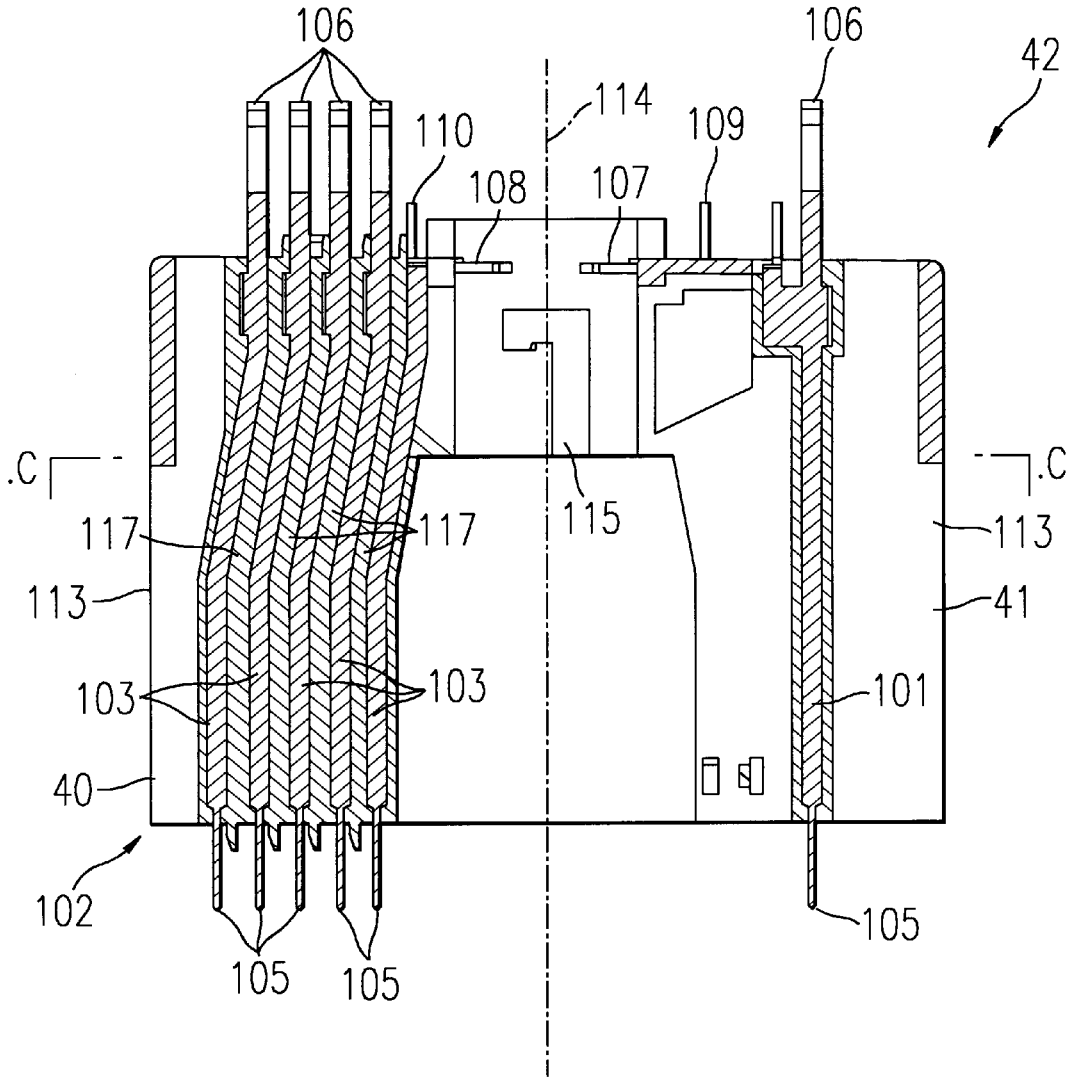
FIG. 6 shows a mounting for a power consumer in a cutaway lateral view and a cutaway plan view along cutting plane C—C.
Figure 6:
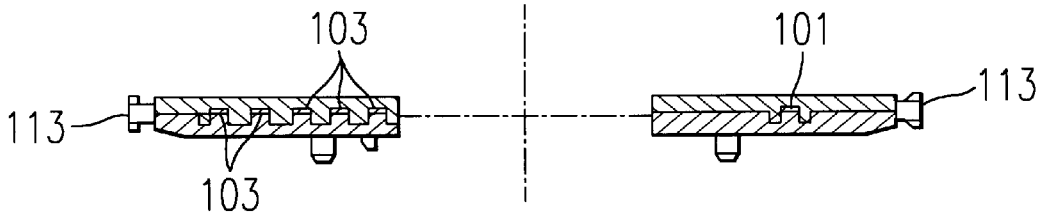

FIG. 6 illustrate the embodiment of FIG. 11 in a form cutaway in parallel to legs 40 and 41 and in assembled form.

What is claimed is:

1. Signaling device for signaling operating and malfunctioning conditions for electrical machines, comprising: at least two signal transmitters arranged essentially linearly with respect to each other and connected to a power source via power lines, the signal transmitters respectively having a case, in which power consumers for generating a signal are arranged, wherein adjacently arranged cases are interconnected via a coupling member, and wherein the power consumers are configured to be connected to each other and to the power lines, wherein the power consumers are arranged in mountings and the mountings have a conductive device, which detachably interconnects the power consumers to adjacent cases, wherein the case is configured to be connected at a lid to a closing lid, which is configured to be fixed to the case by a coupling ring.

2. Signaling device for signaling operating and malfunctioning conditions for electrical machines, comprising: at least two signal transmitters arranged essentially linearly with respect to each other and connected to a power source via power lines, the signal transmitters respectively having a case, in which power consumers for generating a signal are arranged, wherein adjacently arranged cases are interconnected via a coupling member, and wherein the power consumers are configured to be connected to each other and to the power lines, wherein the power consumers are arranged in mountings and the mountings have a conductive device, which detachably interconnects the power consumers to adjacent cases, wherein the mounting is made of two halves and the two halves of the mounting are configured to be assembled by at least one snap-connection, and the mounting is essentially U-shaped and has two legs and a bar connecting the legs.

3. Signaling device according to claim 2, wherein the power consumer is arranged between the two legs.

4. Signaling device for signaling various operating and malfunctioning conditions for electrical machines, comprising: at least two optical signal transmitters arranged essentially linearly with respect to each other and connected to a power source via power lines, the signal transmitters respectively having a case, in which power consumers for generating an optical signal are arranged, wherein adjacently arranged cases are interconnected via a coupling member, and wherein the power consumers are configured to be connected to each other and to the power lines, wherein the power consumers are arranged in mountings, and the mountings have a conductive device, which detachably interconnects the power consumers to adjacent cases, wherein the mounting is made of two halves and the two halves of the mounting are configured to be assembled by at least one snap-connection.

5. Signaling device according to claim 4, wherein the two halves of the mounting respectively have two snap-in hooks and two snap-recesses.

6. Signaling device for signaling operating and malfunctioning conditions for electrical machines, comprising: at least two signal transmitters arranged essentially linearly with respect to each other and connected to a power source via power lines, the signal transmitters respectively having a case, in which power consumers for generating a signal are arranged, wherein adjacently arranged cases are interconnected via a coupling member, and wherein the power consumers are configured to be connected to each other and to the power lines, wherein the power consumers are arranged in mountings and the mountings have a conductive device, which detachably interconnects the power consumers to adjacent cases, wherein the case is configured to be connected at a lid to a closing lid, which is configured to be fixed to the case by a coupling ring, and at the mounting, an adapter for a signal transmitter is arranged and has an essentially light-proof board, which together with the case, defines a chamber, wherein the power consumer is arranged.

7. Signaling device according to claim 6, wherein the mounting is essentially U-shaped and has two legs, and the board connects the legs.

8. Signaling device according to claim 7, wherein the board is circular in shape.

9. Signaling device according to claim 4, wherein the mounting is divided in the plane of the conductor strips.

* * * * *